US006700546B2

(12) United States Patent
Benhammou et al.

(10) Patent No.: US 6,700,546 B2
(45) Date of Patent: Mar. 2, 2004

(54) ELECRONIC KEY READER

(75) Inventors: David Benhammou, Pantin (FR); Gérard Bonnefoy, Paris (FR)

(73) Assignee: Construction Diffusion Vente Internationale- Societe Anonyme, Pantin (FR)

( * ) Notice: Subject to any disclaimer, the term of this patent is extended or adjusted under 35 U.S.C. 154(b) by 0 days.

(21) Appl. No.: 10/148,020

(22) PCT Filed: Dec. 7, 2000

(86) PCT No.: PCT/FR00/03423

§ 371 (c)(1),
(2), (4) Date: May 24, 2002

(87) PCT Pub. No.: WO01/50423

PCT Pub. Date: Jul. 12, 2001

(65) Prior Publication Data

US 2002/0190126 A1 Dec. 19, 2002

(30) Foreign Application Priority Data

Jan. 5, 2000 (FR) ..... 00 00072

(51) Int. Cl.[7] ..... H01Q 21/00

(52) U.S. Cl. ..... 343/728; 343/767; 343/866

(58) Field of Search ..... 343/866, 867, 343/702, 767, 725, 728

(56) References Cited

U.S. PATENT DOCUMENTS

| | | | | |
|---|---|---|---|---|
| 3,987,454 A | | 10/1976 | Epis | 343/771 |
| 4,723,305 A | * | 2/1988 | Phillips et al. | 455/90 |
| 5,175,560 A | * | 12/1992 | Lucas et al. | 343/767 |
| 5,486,836 A | | 1/1996 | Kuffner et al. | 343/700 MS |
| 6,070,803 A | | 6/2000 | Stobbe | 235/492 |

FOREIGN PATENT DOCUMENTS

| | | | |
|---|---|---|---|
| EP | 0625832 | 11/1994 | H04B/1/59 |
| FR | 2728614 | 6/1996 | E05B/49/04 |

* cited by examiner

*Primary Examiner*—Hoang V. Nguyen
(74) *Attorney, Agent, or Firm*—Greenblum & Bernstein, P.L.C.

(57) ABSTRACT

Electronic key reader includes a protective metal housing member having a front surface with a center and edges. At least one slot extends from at least one of the edges to the center of the front surface.

32 Claims, 2 Drawing Sheets

ELECRONIC KEY READER

CROSS-REFERENCE TO RELATED APPLICATIONS

The present application is a National Stage Application of International Application No. PCT/FR00/03423, filed Dec. 7, 2000. Further, the present application claims priority under 35 U.S.C. §119 of French Patent Application No. 00/00072 filed on Jan. 5, 2000.

BACKGROUND OF THE INVENTION

1. Field of the Invention

The present invention concerns improvements relating to electronic key readers.

2. Description of Background and Relevant Information

In the field of access controls, each authorized user has a badge provided with an electronic device which, once fed by an outside source, emits a coded signal allowing a door to open, for instance, when it is recognized by the reader.

The reader transmits the energy necessary to the functioning of the badge by a self-inductance coupling, which means that the reader and the badge both comprise an antenna that is in the form of a coil.

The reader is arranged on the exterior of the premises to which one controls access, and means preventing acts of vandalism need to be provided. Generally, the reader is enclosed in a very resistant metal housing that is solidly fixed to the frontage. The outer surface of this housing has slots to allow the flux from the antenna to radiate outward. In some cases, the reader is embedded and its front surface is protected by a metal plate.

Experiments have shown that, to be efficient, the badge should be placed relatively close to the reader, which is explained in that the metal housing, or the plate, acts like a turn that is traversed by the flux emitted by the antenna which absorbs part of the energy emitted by the latter by transforming it into heat.

SUMMARY OF THE INVENTION

The present invention, which overcomes this drawback, is remarkable in that the housing has a slot extending from one of the edges of the housing substantially to the center of the front surface of the latter.

An electronic key reader includes a protective metal housing member comprising a front surface having a center and edges. At least one slot extends from at least one of the edges to the center of the front surface.

The protective metal housing may have the form of a plate, the at least one slot may comprise an open end and one end that extends beyond a median line connecting sides which are adjacent to a side that includes the open end. The at least one slot may comprise an open end that is arranged at one of the edges. The front surface may be four-sided and the at least one slot may open out at the at least one of the edges. The front surface may be polygonal and the at least one slot may open out at the at least one of the edges.

The key reader may further comprise an antenna loop arranged to surround a center region of the front surface. The key reader may further comprise an antenna loop, wherein the at least one slot traverses the antenna loop. The key reader may further comprise openings arranged on the protective metal housing.

The at least one slot may comprise a first slot and a second slot, the first slot extending from one edge and the second slot extending from a different edge. The key reader may further comprise a plurality of lateral surfaces. The at least one slot may extend into at least one of the plurality of lateral surfaces.

The invention also provides for an electronic key reader comprising a protective metal plate comprising a front surface, a center region, and edges. The protective metal plate comprises at least one slot extending from at least one the edges to the center region.

The at least one slot comprises an open end that is arranged at one of the edges. The protective metal plate may be four-sided and wherein the at least one slot opens at the at least one of the edges. The protective metal plate may be polygonal and wherein the at least one slot opens at the at least one of the edges.

The key reader may further comprise an antenna loop arranged to surround the center region of the front surface. The key reader may further comprise an antenna loop, wherein the at least one slot traverses the antenna loop. The key reader may further comprise corner openings arranged on the protective metal plate. The at least one slot may comprise a first slot and a second slot, the first slot extending from one edge and the second slot extending from a different edge. The key reader may further comprise a plurality of lateral surfaces. The at least one slot may extend into at least one of the plurality of lateral surfaces.

The invention also provides for an electronic key reader comprising a member comprising one of a protective metal plate and a protective metal housing. The member comprises a front surface, at least one edge, and at least two opposite sides. At least one slot comprises an open end and a closed end, the at least one slot having a length which is defined between the open and closed ends. The length is equal to or greater than a length of the two opposite sides.

The member may be four-sided. The member may be polygonal. The key reader may further comprise an antenna loop arranged to surround a center region of the front surface. The key reader may further comprise an antenna loop, wherein the at least one slot traverses the antenna loop. The key reader may further comprise corner openings. The at least one slot may comprise a first slot and a second slot, the first slot extending from one edge and the second slot extending from a different edge. The key reader may further comprise a plurality of lateral surfaces. The at least one slot may extend into at least one of the plurality of lateral surfaces.

BRIEF DESCRIPTION OF THE DRAWINGS

The present invention will be better understood from the following description, with reference to the annexed drawings given only by way of example, and in which.

DETAILED DESCRIPTION OF THE INVENTION

Figure 1:
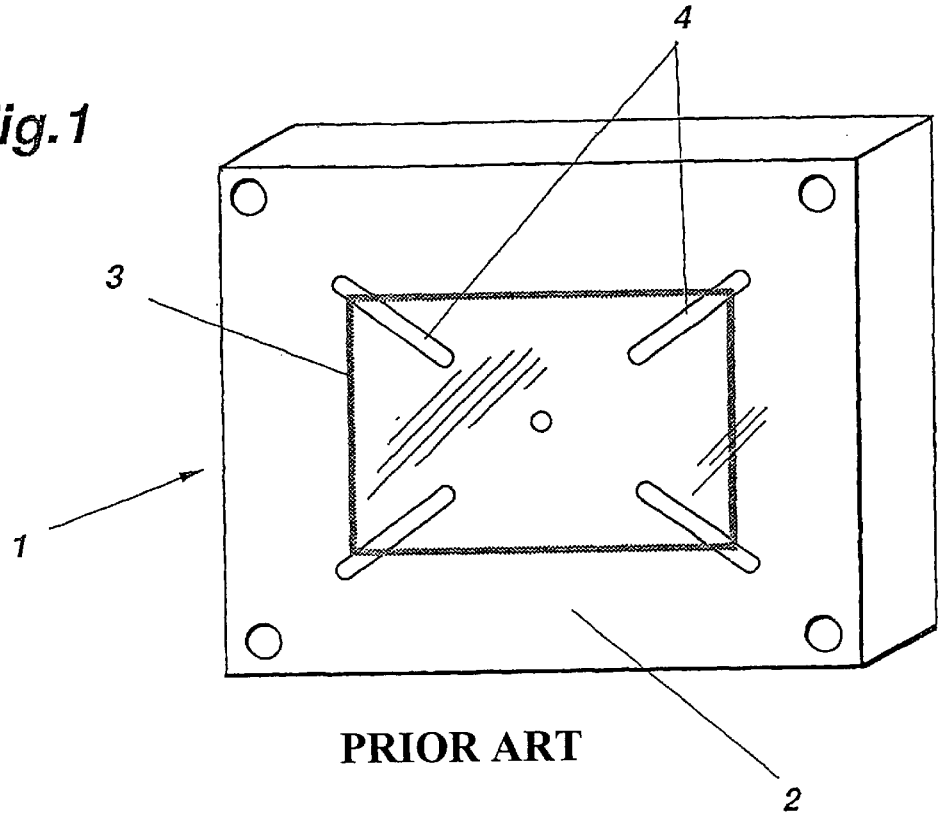
FIG. 1 is a perspective view of a known housing.

In referring to FIG. 1, one can see that the reader is enclosed in a metal housing 1, behind the front surface 2 of which a common antenna, represented schematically by the loop 3, is arranged.

Openings 4 are provided on the surface 2 to allow the flux emitted by the loop 3 to exit. Experiments have shown that only a small portion of the energy radiated by the loop 3 was received by the user's badge, thus making it necessary for the latter to be relatively close to the reader.

This phenomenon is explained in that the housing acts like a self-inductance turn and absorbs part of the flux emitted by the antenna 3.

The present invention, which enables overcoming the aforementioned drawback, is remarkable in that the housing has a slot 5 extending from the edge 2*a* of the surface 2 to the center of said surface, said slot extending over the lateral surface 6 of the housing to open out on its field 6*a*.

When the housing is limited to a metal plate covering the reader, which is embedded, the aforementioned slot opens out on any one of the sides of said plate.

Figure 2:
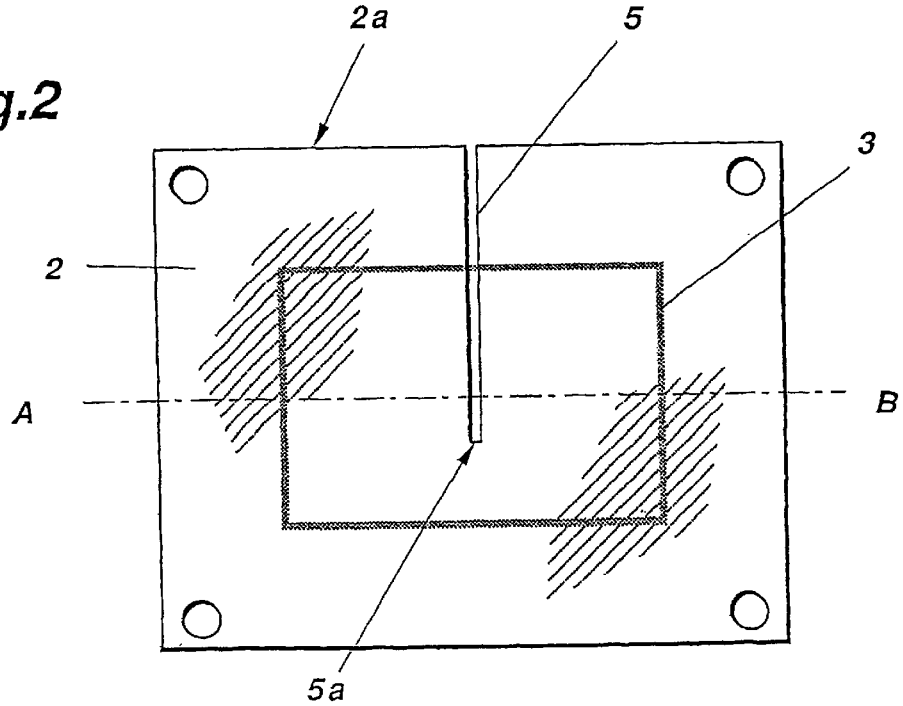
PRIOR ART Fig.2
FIG. 2 is a front view of a housing according to the invention.
Figure 3:
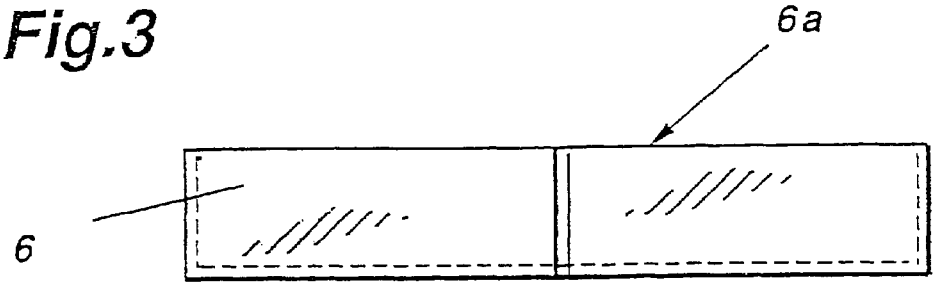
FIG. 3 is the top view of FIG. 2.

Experiments have shown that the effect of absorption resulting from the metal housing was substantially reduced by the single presence of the slot 5 of FIG. 2, therefore making it possible for a user to be recognized even though he is at a distance from the reader that is much greater than the one at which he was previously.

Naturally, nothing contradicts providing openings similar to those 4 on the front surface of the reader.

Figure 4:
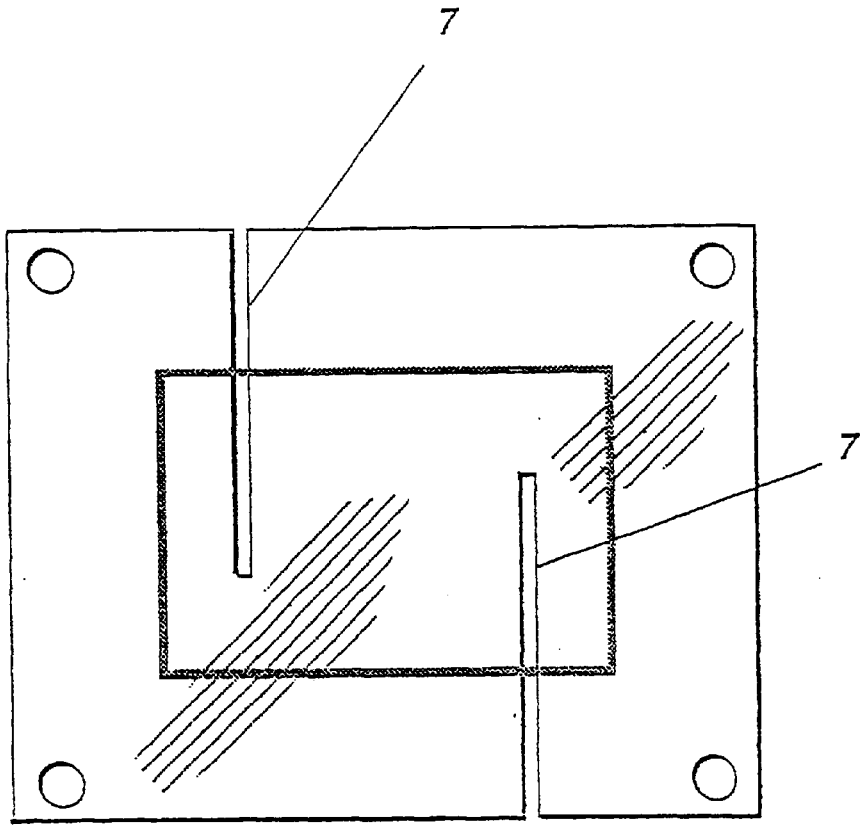
FIG. 4 is a view, similar to FIG. 2, showing an alternative embodiment.

The result of the invention can be improved by providing several slots, such as those 7 of FIG. 4.

Preferably, the end 5*a* of the slot 5 extends beyond the median line AB that connects the middle of the sides adjacent to the one which said slot opens out on.

What is claimed is:

1. Electronic key reader comprising:

a protective metal housing member comprising a front surface having a center and edges;

at least one slot extending from at least one of the edges to at least the center of the front surface, wherein the electronic key reader is configured to read an electronic device.

2. The key reader of claim 1, wherein the protective metal housing member has the form of a plate.

3. The key reader of claim 1, wherein the at least one slot comprises an open end and one end that extends beyond a median line connecting sides which are adjacent to a side that includes the open end.

4. The key reader of claim 1, wherein the at least one slot comprises an open end that is arranged at one of the edges.

5. The key reader of claim 1, wherein the front surface is four-sided and wherein the at least one slot opens out at the at least one of the edges.

6. The key reader of claim 1, wherein the front surface is polygonal and wherein the at least one slot opens out at the at least one of the edges.

7. The key reader of claim 1, further comprising an antenna loop.

8. The key reader of claim 1, further comprising an antenna loop, wherein the at least one slot traverses the antenna loop.

9. The key reader of claim 1, further comprising openings arranged on the protective metal housing member.

10. The key reader of claim 1, wherein the at least one slot comprises a first slot and a second slot, the first slot extending from one edge and the second slot extending from a different edge.

11. The key reader of claim 1, further comprising a plurality of lateral surfaces.

12. The key reader of claim 1, wherein the at least one slot extends into at least one of the plurality of lateral surfaces.

13. Electronic key reader comprising:

a protective metal plate comprising a front surface, a center region, and edges;

the protective metal plate comprising at least one slot extending from at least one of the edges to the center region, wherein the electronic key reader is configured to read an electronic device.

14. The key reader of claim 13, wherein the at least one slot comprises an open end that is arranged at one of the edges.

15. The key reader of claim 13, wherein the protective metal plate is four-sided and wherein the at least one slot opens out at the at least one of the edges.

16. The key reader of claim 13, wherein the protective metal plate is polygonal and wherein the at least one slot opens out at the at least one of the edges.

17. The key reader of claim 13, further comprising an antenna loop.

18. The key reader of claim 13, further comprising an antenna loop, wherein the at least one slot traverses the antenna loop.

19. The key reader of claim 13, further comprising openings arranged on the protective metal plate.

20. The key reader of claim 13, wherein the at least one slot comprises a first slot and a second slot, the first slot extending from one edge and the second slot extending from a different edge.

21. The key reader of claim 13, further comprising a plurality of lateral surfaces.

22. The key reader of claim 21, wherein the at least one slot extends into at least one of the plurality of lateral surfaces.

23. Electronic key reader comprising:

a member comprising one of a protective metal plate and a protective metal housing;

the member comprising a front surface, at least one edge, and at least two opposite sides;

at least one slot comprising an open end and a closed end, the at least one slot having a length which is defined between the open and closed ends, wherein the length is equal to or greater than a length of the two opposite sides, and wherein the electronic key reader is configured to read an electronic device.

24. The key reader of claim 23, wherein the member is four-sided.

25. The key reader of claim 23, wherein the member is polygonal.

26. The key reader of claim 23, further comprising an antenna loop.

27. The key reader of claim 23, further comprising an antenna loop, wherein the at least one slot traverses the antenna loop.

28. The key reader of claim 23, further comprising openings.

29. The key reader of claim 23, wherein the at least one slot comprises a first slot and a second slot, the first slot extending from one edge and the second slot extending from a different edge.

30. The key reader of claim 23, further comprising a plurality of lateral surfaces.

31. The key reader of claim 30, wherein the at least one slot extends into at least one of the plurality of lateral surfaces.

32. Electronic key reader comprising:

a metal member comprising a front surface having a center and edges;

at least one slot extending from at least one of the edges to the center of the front surface, wherein the at least one slot comprises an open end and one end that extends beyond a median line connecting sides which are adjacent to a side that includes the open end, and wherein the electronic key reader is configured to read an electronic device.

* * * * *